US008206150B2

(12) United States Patent
Wade

(10) Patent No.: US 8,206,150 B2
(45) Date of Patent: Jun. 26, 2012

(54) METHOD FOR EXTINGUISHING A CANDLE AT TIMED INTERVALS USING A COMBUSTIBLE MATERIAL

(76) Inventor: Travis Aaron Wade, North Hollywood, CA (US)

( * ) Notice: Subject to any disclaimer, the term of this patent is extended or adjusted under 35 U.S.C. 154(b) by 298 days.

(21) Appl. No.: 12/729,223

(22) Filed: Mar. 22, 2010

(65) Prior Publication Data

US 2010/0173254 A1 Jul. 8, 2010

Related U.S. Application Data

(63) Continuation-in-part of application No. 11/850,668, filed on Sep. 5, 2007, now Pat. No. 7,682,149.

(51) Int. Cl.
*F23D 3/18* (2006.01)

(52) U.S. Cl. ..... 431/325; 431/288; 431/33

(58) Field of Classification Search ..... 431/33, 431/288, 325
See application file for complete search history.

(56) References Cited

U.S. PATENT DOCUMENTS

| | | | | | |
|---|---|---|---|---|---|
| 1,067,184 | A | | 7/1913 | Lynch | |
| 1,360,283 | A | * | 11/1920 | Fairburn | 149/37 |
| 2,058,574 | A | * | 10/1936 | Dreyfus | 8/130 |
| 2,374,913 | A | * | 5/1945 | Zimmer et al. | 508/539 |
| 2,733,253 | A | * | 1/1956 | Milbers et al. | 554/189 |
| 3,123,102 | A | * | 3/1964 | Frieder et al. | 138/125 |
| 3,428,409 | A | * | 2/1969 | Summers | 431/289 |
| 3,466,135 | A | * | 9/1969 | Summers | 431/289 |
| 3,753,654 | A | * | 8/1973 | Eggertsen | 436/154 |
| 3,773,460 | A | * | 11/1973 | Tellier | 431/289 |
| 4,104,073 | A | * | 8/1978 | Koide et al. | 106/18 |
| 4,343,854 | A | * | 8/1982 | Moorman | 442/146 |
| 4,459,131 | A | * | 7/1984 | Cremonese | 44/507 |
| 4,503,322 | A | * | 3/1985 | Kishimoto et al. | 219/505 |
| 5,120,581 | A | * | 6/1992 | Brunken et al. | 427/387 |
| 5,153,553 | A | * | 10/1992 | Ruehl et al. | 337/273 |
| 5,204,186 | A | * | 4/1993 | Brunken et al. | 428/447 |
| 5,391,583 | A | * | 2/1995 | Blount | 521/85 |
| 5,417,878 | A | * | 5/1995 | Takahata et al. | 510/153 |
| 5,865,862 | A | * | 2/1999 | Hassan | 44/507 |
| 5,961,967 | A | * | 10/1999 | Powell et al. | 424/76.4 |
| 6,186,776 | B1 | * | 2/2001 | Myerchin | 431/287 |
| 6,447,286 | B1 | | 9/2002 | Snuggs | |
| 6,507,264 | B1 | * | 1/2003 | Whitney | 337/159 |
| 6,616,861 | B1 | * | 9/2003 | Evans et al. | 252/188.28 |
| 6,645,637 | B2 | * | 11/2003 | Kaltenborn et al. | 428/447 |
| 6,652,269 | B1 | * | 11/2003 | Stenger | 431/325 |

(Continued)

FOREIGN PATENT DOCUMENTS

GB 1405705 * 10/1975

*Primary Examiner* — Kenneth Rinehart
*Assistant Examiner* — Jorge Pereiro
(74) *Attorney, Agent, or Firm* — George R. Reardon

(57) ABSTRACT

A method for extinguishing a candle at timed intervals using a combustible material is disclosed. In one exemplary embodiment, the method includes: utilizing a combustible composition adapted for application to a wick segment; utilizing a combustible first wick segment; coupling a combustible second wick segment to the combustible first wick segment; placing the combustible second wick segment adjacent to the first wick segment; and configuring the combustible second wick segment to, as the combustible first wick segment, once ignited, burns down to the combustible second wick segment, interrupt and slowly self-extinguish the burning of the first wick segment. The candle wick is configured to be relit, post extinguishment, without having to physically remove a non-combustible barrier. A combustible composition also is disclosed. A candle further is disclosed.

1 Claim, 3 Drawing Sheets

U.S. PATENT DOCUMENTS

| | | | | |
|---|---|---|---|---|
| 6,747,074 | B1 * | 6/2004 | Buckingham et al. | 523/179 |
| 6,805,551 | B1 | 10/2004 | Feuer | |
| 6,823,548 | B2 * | 11/2004 | Murphy et al. | 5/698 |
| 7,040,888 | B2 | 5/2006 | Keiffer et al. | |
| 2002/0004547 | A1 * | 1/2002 | Kaltenborn et al. | 524/442 |
| 2003/0124474 | A1 | 7/2003 | Elliott, III et al. | |
| 2004/0091829 | A1 | 5/2004 | Mack et al. | |
| 2005/0164141 | A1 * | 7/2005 | Paasch et al. | 431/325 |
| 2006/0019209 | A1 | 1/2006 | Ortiz, Jr. | |
| 2006/0292508 | A1 * | 12/2006 | Reisman et al. | 431/289 |
| 2006/0292509 | A1 * | 12/2006 | Reisman et al. | 431/289 |
| 2007/0048684 | A1 * | 3/2007 | Cole et al. | 431/291 |
| 2007/0165990 | A1 * | 7/2007 | Magill et al. | 385/103 |
| 2008/0113308 | A1 * | 5/2008 | Kleve | 431/253 |
| 2008/0241771 | A1 * | 10/2008 | Morneau Chapados | 431/35 |

* cited by examiner

METHOD FOR EXTINGUISHING A CANDLE AT TIMED INTERVALS USING A COMBUSTIBLE MATERIAL

CROSS-REFERENCE TO RELATED APPLICATION(S)

This present non-provisional patent application is a continuation-in-part of copending U.S. patent application Ser. No. 11/850,668 filed on Sep. 5, 2007, and entitled "TIMED WICK AND CANDLE THEREOF," and of which the application cited above is incorporated in-full by reference herein.

FIELD OF THE INVENTION

The technology described herein relates generally to the fields of candle wicks and candles and methods of making the same. More specifically, the technology relates to a method for extinguishing a candle at timed intervals using a combustible material consisting essentially of a wick designed with the ability to automatically and slowly self-extinguish a flame in equal-time intervals.

BACKGROUND OF THE INVENTION

The purpose of a candle wick is to provide a candle with a flame. The heat from the flame melts the wax surrounding the base of the wick directly beneath it. The melted wax is then drawn up within the wick providing fuel for the flame. This ongoing cycle allows the candle to burn continuously. Wax in solid state is melted by the heat of the flame and converts to a liquid state. The liquid wax is drawn up to the top of the wick inside the flame and continues the burning process. The cycle repeats itself until the wick is no longer functioning due to lack of fuel for the flame.

Candles have been used for many years and for many different reasons; the reasons vary depending on the user. Today, a large number of candles are purchased simply for their pleasant fragrances and decorative appearance. The aromatherapy derived from a candle is widely used as well. It entices the user to relax and forget about everyday responsibilities.

However, one problem that exists between the user and the candle is that the user neglects to extinguish the candle. People today are simply too busy to remember to blow out a candle prior to leaving their homes. Panic sets in. A candle equipped with a wick that will automatically extinguish a candle flame in equal-time intervals would provide a user with the security of knowing that their candle will self extinguish in a short period of time.

Another problem that exists today is the vast number of house fires caused by leaving a candle unattended. The average burning time for a candle may be 60 to 95 hours. This time period is too long since it creates a greater risk of the candle being knocked over by a house pet, wind, or even a small child. Limiting the amount of burning time from one to four hours could significantly reduce the risk of house fires.

Related patents known in the art include the following: U.S. Pat. No. 1,067,184, issued to Lynch on Jul. 8, 1913, discloses a candle. U.S. Pat. No. 6,447,286, issued to Snuggs on Sep. 10, 2002, discloses a candle extinguishing apparatus. U.S. Pat. No. 6,805,551, issued to Feuer on Oct. 19, 2004, discloses a device for creating a self-extinguishing candle and a candle including such a device. U.S. Pat. No. 7,084,888, issued to Keiffer et al. on May 9, 2006, discloses a smart wick.

Relate published patent applications in the art include the following: U.S. Patent Application No. 2006/0019209 filed by Ortiz, Jr. and published on Jan. 26, 2006, discloses self-extinguishing safety candle wicks and methods of manufacture of the wicks. U.S. Patent Application No. 2004/0091829 filed by Mack et al. and published on May 13, 2004, discloses a self-extinguishing wick and method of producing the same. U.S. Patent Application No. 2003/0124474, filed by Elliott, III et al. and published on Jul. 3, 2003, discloses self-extinguishing candles and method of making the same.

While these patents and other previous methods have attempted to solve the problems that they addressed, none address using a combustible material to self-extinguish a candle, as does embodiments of the technology disclosed herein.

Therefore, a need exists for a timed wick and candle with these attributes and functionalities. The timed wick and candle according to embodiments of the invention substantially departs from the conventional concepts and designs of the prior art. It can be appreciated that there exists a continuing need for a new and improved timed wick and candle which can be used commercially. In this regard, the technology disclosed herein substantially fulfills these objectives.

The foregoing patent and other information reflect the state of the art of which the inventor is aware and are tendered with a view toward discharging the inventor's acknowledged duty of candor in disclosing information that may be pertinent to the patentability of the technology disclosed herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides for a candle and a method for extinguishing a candle at timed intervals using a combustible material consisting essentially of a wick designed with the ability to automatically and slowly self-extinguish a flame in equal-time intervals.

In one exemplary embodiment, the technology described herein provides a method for extinguishing a candle at timed intervals using a combustible material. The method includes: utilizing a combustible composition adapted for application to a wick segment; utilizing a combustible first wick segment; coupling a combustible second wick segment to the combustible first wick segment; placing the combustible second wick segment adjacent to the first wick segment; and configuring the combustible second wick segment to, as the combustible first wick segment, once ignited, burns down to the combustible second wick segment, interrupt and slowly self-extinguish the burning of the first wick segment. The candle wick is configured to be relit, post extinguishment, without having to physically remove a non-combustible barrier.

The method also can include: configuring the combustible first wick segment to be a predetermined length, such that, based on a candle type, length, width, and size, in which the combustible first wick segment is placed, a known burn time is approximated at which point a burning of the combustible first wick segment reaches the combustible second wick segment and automatically and slowly self-extinguishes, thereby providing the self-extinguishing, timed-interval candle wick with automatic and slow self-extinguishment at a known, approximated time subsequent to a lighting of the combustible first wick segment.

The method further can include: utilizing a plurality of combustible first wick segments; and utilizing a plurality of combustible second wick segments and interspersing one combustible second wick segment between each two combustible first wick segments. The plurality of combustible first wick segments are of generally equal widths and lengths, thereby providing a regular time interval at which the candle wick is automatically and slowly self-extinguished each time the candle is lit.

The method also can include: varying the regular time interval by increasing or decreasing the lengths of the plurality of combustible first wick segments.

The method further can include: configuring the candle wick to be relit, post extinguishment, without having to physically remove a non-combustible barrier.

The method also can include: forming the combustible second wick segment by spirally wrapping the combustible composition around a heat set and subsequently interweaving with the combustible first wick segment at a predetermined location. The combustible composition can be an organic polymer. The organic polymer can be a fatty acid created through the hydrolysis of beef fat with caustic soda and potash. The organic polymer can be a malleable solid in the form of a bead that is placed upon a combustible first wick segment at a predetermined location. The bead can be spherical.

The method further can include: adding to the combustible composition an extinguishing agent additive to increase the material resistance to burn.

The method further can include: adding to the combustible composition a metal additive to increase volatility to aid in the re-light process.

In yet another exemplary embodiment, the technology described herein provides a combustible composition for extinguishing a candle at timed intervals. The combustible composition includes: an organic polymer comprising a fatty acid created through the hydrolysis of beef fat with caustic soda and potash, wherein the organic polymer is a malleable solid in the form of a bead that is placed upon a combustible wick segment at a predetermined location.

The combustible composition also can include: an extinguishing agent additive to increase the material resistance to burn.

The combustible composition also can include: a metal additive to increase volatility to aid in the re-light process.

In yet another exemplary embodiment, the technology described herein provides a candle adapted for extinguishment at timed intervals using a combustible material. The candle includes: a polymeric base; a combustible first wick segment; and a combustible second wick segment adapted to be coupled adjacent to the combustible first wick segment. The combustible second wick segment is adapted to, as the combustible first wick segment, once ignited, burns down to the combustible second wick segment, interrupt and slowly self-extinguish the burning of the first wick segment. The candle wick is configured to be relit, post extinguishment, without having to physically remove a non-combustible barrier.

The candle also can include: a plurality of combustible first wick segments; and a plurality of combustible second wick segments interspersed one combustible second wick segment between each two combustible first wick segments. The plurality of combustible first wick segments are of generally equal widths and lengths, thereby providing a regular time interval at which the candle wick is automatically and slowly self-extinguished each time the candle is lit.

The combustible first wick segment is a predetermined length, such that, based on a candle type, length, width, and size, in which the combustible first wick segment is placed, a known burn time is approximated at which point a burning of the combustible first wick segment reaches the combustible second wick segment and automatically and slowly self-extinguishes, thereby providing the self-extinguishing, timed-interval candle wick with automatic and slow self-extinguishment at a known, approximated time subsequent to a lighting of the combustible first wick segment.

The polymeric base further can include an organic polymer having a fatty acid created through the hydrolysis of beef fat with caustic soda and potash. The organic polymer can be a malleable solid in the form of a bead that is placed upon a combustible wick segment at a predetermined location. The bead can be spherical.

Advantageously, the technology described herein provides minimal alteration to the aesthetics of a candle. Also advantageously, the combustible extinguishing barrier describer herein does not require a special tool other than the original device used to light the candle. Further advantageously, the technology described herein provides for numerous candle applications, including variations in size, style, interval timing, and extinguishment timing.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides for a candle and a method for extinguishing a candle at timed intervals using a combustible material consisting essentially of a wick designed with the ability to automatically and slowly self-extinguish a flame in equal-time intervals.

Figure 1:
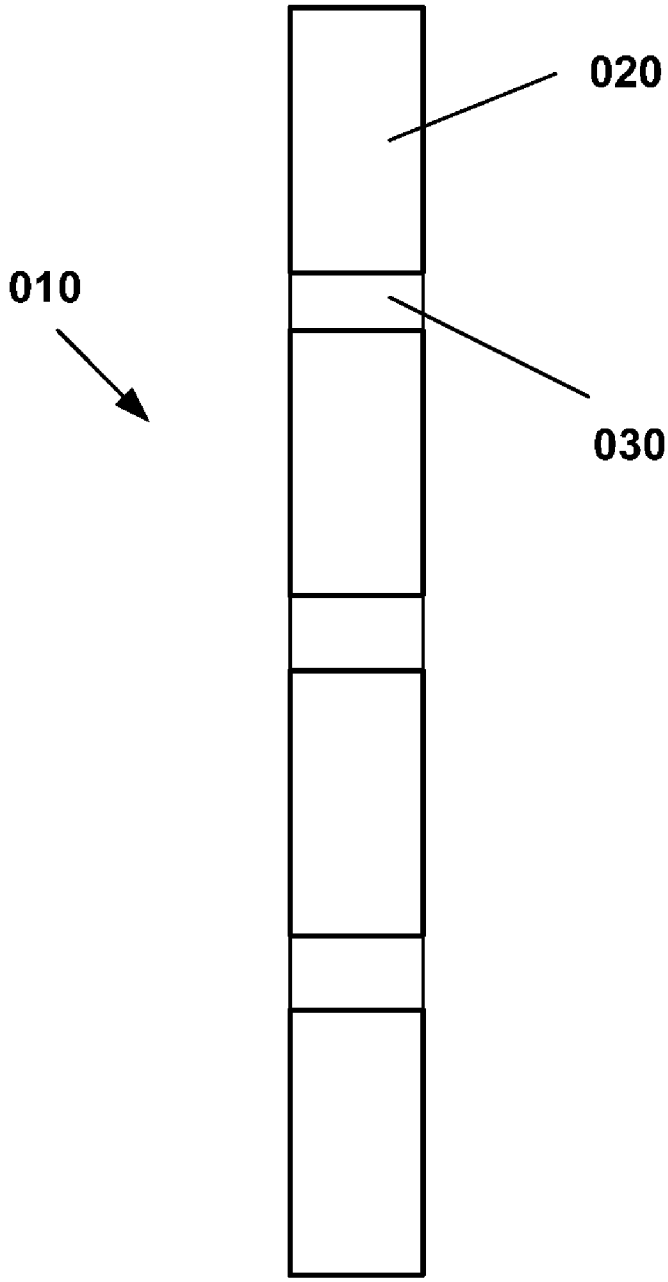
FIG. 1 is a schematic diagram of a timed wick structure adapted for extinguishing a candle at timed intervals using a combustible material consisting essentially of a wick designed with the ability to automatically and slowly self-extinguish a flame in equal-time intervals, according to an embodiment of the technology.
Figure 2:
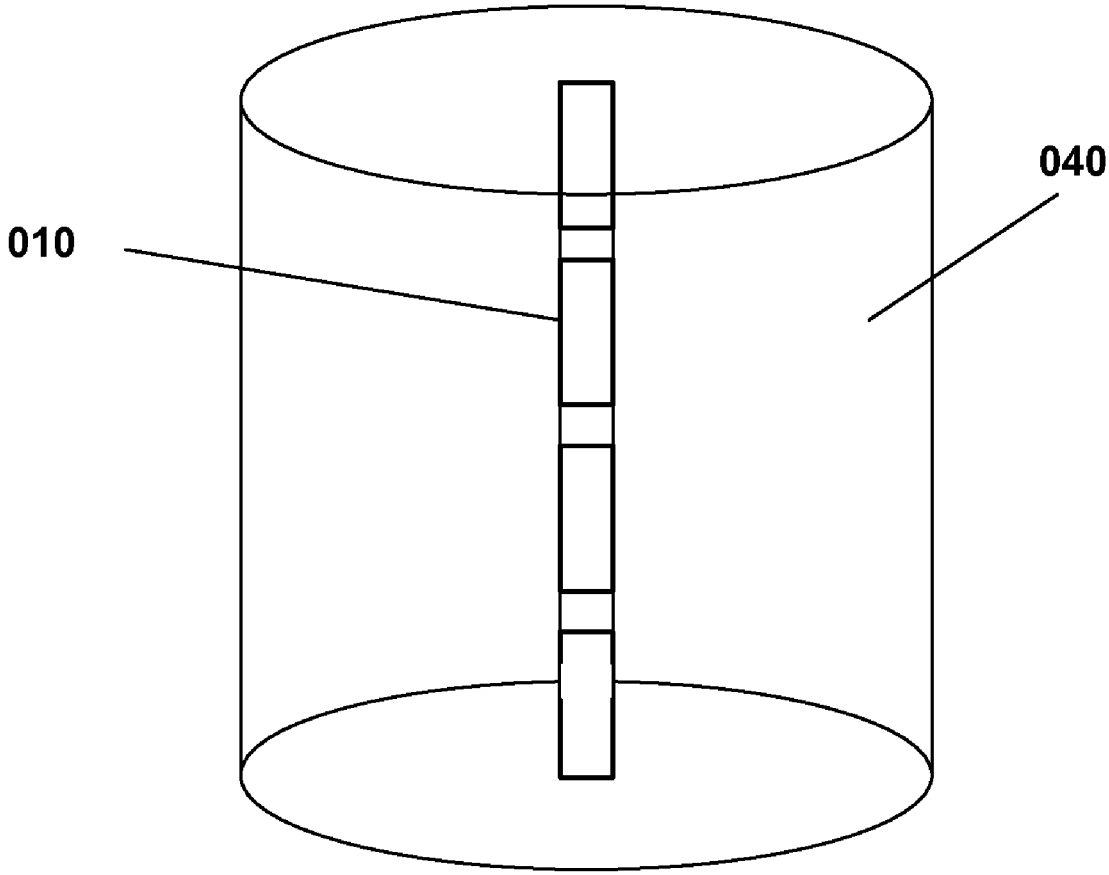
FIG. 2 is a schematic diagram of the timed wick structure depicted in FIG. 1, shown in use in a candle, according to an embodiment of the technology.
Figure 3A:
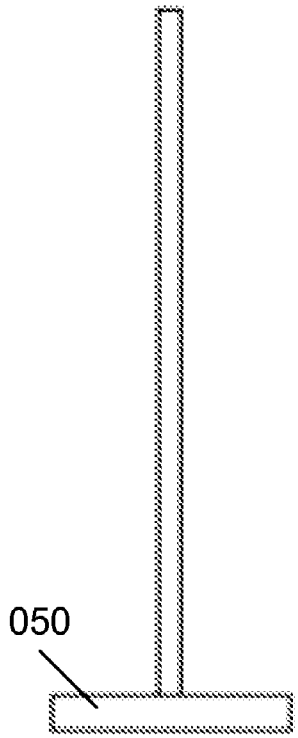
FIG. 3A is a schematic diagram of a timed wick secured to a base prior to having a combustible substance applied, according to an embodiment of the technology disclosed herein.
Figure 3B:
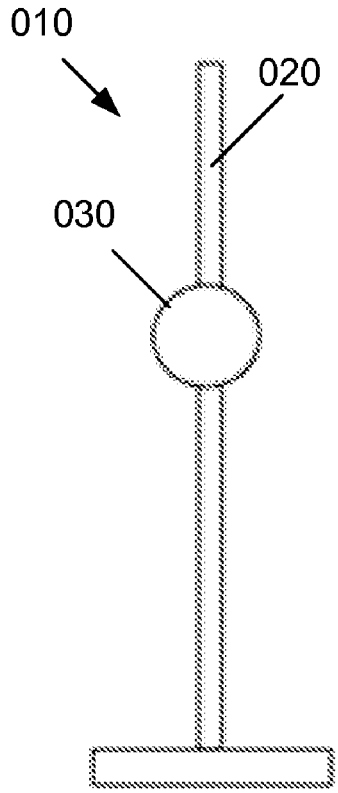
FIG. 3B is a schematic diagram of the timed wick secured to a base depicted in FIG. 3A, additionally illustrating the application of a spherical combustible substance to the wick, according to an embodiment of the technology disclosed herein.
Figure 3C:
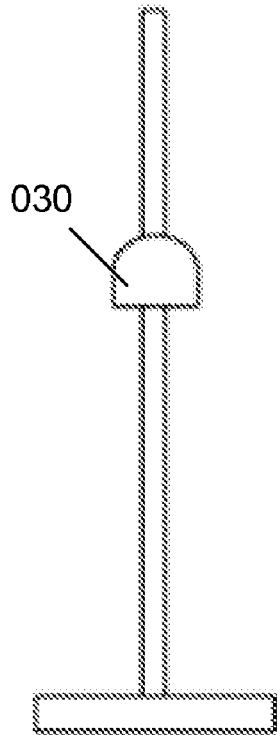
FIG. 3C is a schematic diagram of the timed wick secured to a base depicted in FIG. 3A, additionally illustrating the application of a non-spherical spherical combustible substance to the wick, according to an embodiment of the technology disclosed herein.

Referring now to FIGS. 1 through 3C, a timed wick 010 is shown. The timed wick 010 is comprised of a plurality of a wick segment 020 separated by combustible segment 030. The timed wick may be secured to a base 050 prior to candle wax 040 being formed around the timed wick 010 to form a timed candle.

The technology disclosed herein is directed to creating timed intervals within a candle such that upon completing an interval the candle automatically and slowly self-extinguishes, yet is able to be relit without having to physically remove a non-combustible barrier. Rather than physically removing a barrier, the barrier itself consists of a combustible material that upon additional heat, chemically changes, allowing continued burning of the candle. The combustible material acts to both initially extinguish the burning candle and then combusts to allow continued burning of the candle.

In one embodiment the timing mechanism consists of varied amounts of magnesium metal present throughout the wick segment. The varying amounts of magnesium physically changes the burning characteristics of a candle, resulting in the desired extinguishing with the ability to re-light at a later time, starting a new timed interval designed into the candle.

A second embodiment does not require complete treatment of the wick, but instead allows for the treatment of only the end of intervals within the candle body, positioning the timing mechanism on and around various wick segments. The positioning of the combustible substance is referred to as wick treatment, but is not limited to placing a substance on the wick segment, e.g. the combustible substance may be infused into the wick. Using the magnesium calls for incorporation of the substance within the wick, and various other embodiments may require a contribution from the additives or wax type contained within the candle not just the wick.

In both of these embodiments the end result is the use of a timing mechanism that causes a candle to self-extinguish at a predetermined time, while allowing to be relit at a later time, preserving a wick segment necessary for burning, and not requiring additional effort from an operator other than applying additional heat. (The additional effort refers to many of the methods in the prior art that facilitate this process with non-combustible materials that have to be either physically removed—or require a separate wick segment to be recovered from within the wax body.)

Depending on the embodiment a combination of wick type, wax, and additives may be used to determine an approximate burn time of a candle. Once having defined a candle's burn characteristics, a burn rate in length per time can be determined. A time interval can then be set by identifying a start and end position on the wick segment. For example, a cylindrical pillar consisting of a 1.5" diameter and standing 2.5" in height has been determined to have a total burn time of 10 hours. The relationship between candle height by total burn time dictates that the candle is burning 0.25 inches per hour. At this estimated rate, positioning a treated segment on the wick at 1.25" from the top of the candle would provide two burn intervals of approximately 5 hours.

In an exemplary embodiment the timing mechanism is an organic polymeric substance possessing the burn characteristics described above. The organic polymer is created through the hydrolysis of beef fat with caustic soda and potash. The process is essentially a raw version of saponification that produces a substance consisting mainly of fatty acid (FA) and glycerol (with additional unreacted reactants or byproducts). The resulting FA is a malleable solid that can be physically applied to the wick segment at a predetermined length prior to forming the candle. The treated wick is then placed within the mold and the candle is created as is customary. The FA is placed on zinc core wicks and withstands temperatures of 140° F. Paraffin wax is poured in around this combination and hardens to form a votive candle. The amount of FA applied at the designated wick length is approximately 40-55 mg and effectively extinguishes the candle when the flame comes in contact with the FA.

As is common for solid combustibles, the FA burns more effectively when a sufficient specific area ratio is heated. For example, it is easier to start a fire by lighting smaller twigs than a large branch. Similarly, as the flame approaches the FA only a small portion (specifically the top) comes into contact with the flame—thus causing the candle to burnout. The placement of the FA effectively prevents the wicking process stopping the flow of fuel to the flame. Once extinguished, the user can then take a lighter and apply a flame directly to the FA for 5 to 10 seconds, providing enough heat to quench the specific area ratio requirement and reignite the candle. At this point the FA continues to burn away exposing more of the wick beneath and simultaneously relighting the candle wick. By burning away, the wicking process is once again continued and the heat produces by the combusting FA provides a sufficient melted wax pool for further combustion.

One process for creating the bead material is as follows:

1) Gather the following materials:
   - Raw beef fat (trimmings of fat obtained from butcher)
   - Tap Water
   - Potassium Hydroxide (Caustic Potash—solid)—KOH
   - Sodium Hydroxide (Caustic Soda—solid)—NaOH
   - Hot plate (stove top)
   - Strainer
   - Pipette & Bulb
   - Stainless Steel Bowl 6" Diameter
   - Stainless Steel Bowl 4" Diameter
   - 2×Glass Measuring cup (15 oz capacity)
   - 5 lb scale with 0.1 oz sensitivity
   - Minimum 100 gram scale with 0.001 gram sensitivity
   - Stainless steel mixing utensil
   - Stainless steel spoon Stainless steel ladle
Glass stirrer
Hand and eye protection from corrosive hydroxides
Kettle or heating pot
3×thermometers
plastic storage containers to store up to 4 oz of product
3×250 ml glass beakers
label NaOH soln, KOH soln, and Bi-Product
exacto knife Extract Tallow from Beef Trimmings

- Add beef fat trimmings into kettle or stainless steel pot and apply gradual heating (approximately 2 lbs of fat trimmings were added per batch—this can vary depending on the fat to beef ratio on the meat samples used)
- Maintain fat at approximately 167° F. for a 48 hour period to extract as much liquid tallow from the solid trimmings (required to extract a minimum of 3.2 ounces of liquid fat—depending on fat to beef ratio, may need to add more fat or may have excess)
- Allow trimmings to simmer for 48 hour period—fat may be extracted and process continued. Initial mixture—Separate Fatty Acid (Bead Material) from glycerin and water in tallow
- Weigh out approximately 3.2 ounces of tallow and add to stainless steel bowl (6" diameter).
- Place tallow on hot plate and bring up to 170° F.
- Place 1 floz. Of water in each of the 250 ml beakers labeled NaOH soln and KOH soln
- Weigh out 2 oz. of NaOH solid and gradually add to 250 mL glass beaker labeled NaOH soln—containing 1 floz of water. (Provide agitation with glass stirrer until solid has completely dissolved into soln—soln will turn clear, expect soln will heat up to a minimum temp of 150° F.)
- Weigh out 2 oz. of KOH solid and add to 250 mL glass beaker labeled KOH soln and containing 1 floz. Of water. (Provide agitation with glass stirrer until solid has completely dissolved into soln—soln will turn clear, expect soln will heat up to a minimum temp of 130° F.)
- Simultaneously add the two solutions to your liquid tallow sitting on hot plate and bring entire solution to 170° F. and begin to stir.
- Once mixture has reached 170° F., remove from heat source and continue to stir for 12 minutes. (As mixture proceeds to cool, precipitate will begin to form as the fatty acid solidifies and is precipitated out from the mixture). Adequate cooling is dependent on a steady room temperature not to exceed 68° F. Ideally the mixture should slowly cool to room this room temperature.
- After 12 minutes of stirring, allow mixture to complete cool to room temperature and sit for 24-30 hour period, leave mixture in stainless steel bowl.
- Once mixture has completely solidified and sat for 24 hours at a temperature no greater than 68° F. place mixture back on hotplate.
- Begin to apply gradual cooling not to exceed 100° F. This will begin to separate the solid precipitate layer from the glycerol-aqueous layer. Using your pipette and bulb, begin to extract aqueous layer from mixture, leaving only the precipitate.
- Some of the aqueous layer will remain but try to remove as much water by allowing continuing to heat and allowing some of the aqueous layer to precipitate. Allow continue heating for a minimum of 15 minutes (may vary depending on how much of the aqueous layer you were able to remove using your pipette). Be sure not to heat to the point that the precipitate begins to degrade
- Remove precipitate from vessel and place into a clean stainless steel (4") bowl. Continue heating process to remove as much of the aqueous layer as possible. Using a stainless steel spoon press precipitate to squeeze out additional glycerol and press precipitate into a single solid mass.
- Remove solid mass from stainless steel (4") bowl and place into a plastic storage container for storage. Do not place lid on plastic bowl until solid mass has cooled to room temperature.
- Once solid has cooled to room temperature, affix a lid and allow to sit at room temperature for 48 hours.
- Having sat for 48 hours, place into refrigerator (38° F.) for an additional 4 hours.
- Use this solid material for bead material.

Different ratios of KOH to NaOH can be used to produce bead material of varying physical properties including overall integrity of material ranging from brittle solid (all NaOH) to malleable semi-solid (all KOH). This particular method prepares a fatty material that is malleable enough to apply bead material to wick by hand.

One process for creating a wick for a 2 inch votive is as follows:

- Begin with a primed zinc-core wick usually sold in 3 inch length
- Cut to exactly 2¼ inches in length from the base clip to the end of wick
- Place wick on scale and record weight to the 0.001 grams or 1 mg. Accuracy should be about +/−0.005 grams
- Next mark your wick (measuring from base clip to edge) at 1⅜ inches
- This mark is the location of the bead consequently the first interval. Add the bead material
- Using an exacto knife, cut a sliver of material from the solid (fatty acid) mass prepared in the previous instructions.
- Using your fingers apply on the marked location of the wick, using your fingers to shape the material into a sphere
- Place the wick containing the spherically shaped bead onto the scale and record the weight to the 1 mg of accuracy.
- Subtract the new weight by the old weight identifying the exact amount of bead material added to the wick. Ideally, you should be at about 30 to 35 mg. Use your exacto knife to remove small amounts of bead to reach goal weight. It is ideal to cut at the base of the bead leaving a mushroom shaped bead rather than cutting at the top.
- Having placed bead on wick prepare to prime the treated wick by melting 148° F. paraffin wax. Once wax has cooled to just shy of 148° F., dip your treated wick into the wax to add a coat of wax around entire wick.
- Your wick is ready to add to candle—be sure wick is not subjected to temperatures exceeding too much higher than 148° F., this will insure your bead stays in place and intact.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the disclosed technology and are intended to be covered by the following claims.

What is claimed is:

1. A method for extinguishing a candle at timed intervals using a combustible material, the method comprising:

utilizing a combustible composition adapted for application to a wick segment;

utilizing a combustible first wick segment;

forming a combustible second wick segment by spirally wrapping the combustible composition around a heat set and subsequently interweaving with the combustible first wick segment at a predetermined location;

coupling the combustible second wick segment to the combustible first wick segment;

placing the combustible second wick segment adjacent to the first wick segment; and configuring the combustible second wick segment to, as the combustible first wick segment, once ignited, burns down to the combustible second wick segment, interrupt and self-extinguish the burning of the first wick segment;

wherein the candle wick is configured to be relit, post extinguishment, without having to physically remove a non-combustible barrier.

* * * * *